US009119519B2

(12) United States Patent
Plum et al.

(10) Patent No.: US 9,119,519 B2
(45) Date of Patent: Sep. 1, 2015

(54) DISHWASHER SUMP MEMBER

(75) Inventors: Hans-Dieter Plum, Aachen (DE); Thomas Brinkmann, Bad Aibling (DE)

(73) Assignee: Electrolux Home Products Corporation, N.V., Brussels (BE)

( * ) Notice: Subject to any disclaimer, the term of this patent is extended or adjusted under 35 U.S.C. 154(b) by 823 days.

(21) Appl. No.: 13/259,648

(22) PCT Filed: Mar. 23, 2010

(86) PCT No.: PCT/EP2010/001810
§ 371 (c)(1),
(2), (4) Date: Sep. 23, 2011

(87) PCT Pub. No.: WO2010/108654
PCT Pub. Date: Sep. 30, 2010

(65) Prior Publication Data

US 2012/0017952 A1 Jan. 26, 2012

(30) Foreign Application Priority Data

Mar. 27, 2009 (EP) ..... 09004439

(51) Int. Cl.
*A47L 15/42* (2006.01)

(52) U.S. Cl.
CPC ..... *A47L 15/4246* (2013.01); *A47L 15/4204* (2013.01); *A47L 15/4206* (2013.01); *A47L 15/4217* (2013.01); *A47L 15/4225* (2013.01)

(58) Field of Classification Search
CPC ..... A47L 15/4214; A47L 15/4219; A47L 15/4225; A47L 15/4217; A47L 15/4246
USPC ..... 134/184
See application file for complete search history.

(56) References Cited

U.S. PATENT DOCUMENTS

| | | | | |
|---|---|---|---|---|
| 4,146,405 | A * | 3/1979 | Timmer et al. | 134/115 R |
| 2003/0006305 | A1 | 1/2003 | Hegeman et al. | |
| 2004/0103930 | A1 * | 6/2004 | Lee | 134/93 |
| 2006/0042657 | A1 | 3/2006 | Welch | |

(Continued)

FOREIGN PATENT DOCUMENTS

| | | |
|---|---|---|
| DE | 41 42 697 A1 | 7/1993 |
| DE | 42 14 147 A1 | 11/1993 |

(Continued)

OTHER PUBLICATIONS

International Search Report for International Application No. PCT/EP2010/001810, filed Mar. 23, 2010.

(Continued)

*Primary Examiner* — Michael Barr
*Assistant Examiner* — Spencer Bell
(74) *Attorney, Agent, or Firm* — Alston & Bird LLP

(57) ABSTRACT

A dishwasher comprises a wash chamber, a water circulation system for passing water into and out of the wash chamber, and a water-collecting sump member (12) which is fastened in a water-tight manner to an opening (14) in a lower end portion of the wash chamber. The sump member is a self-contained molded plastic unit comprising an upper portion which constitutes an interface for connecting the sump member in a water-tight manner to said opening (14), and a lower portion comprising a water collecting receptacle, wherein said upper portion comprises at least one integral fitting for connecting the sump member to a water inlet conduit and/or a drain conduit of the dishwasher.

18 Claims, 9 Drawing Sheets

(56) References Cited

U.S. PATENT DOCUMENTS

| | | | | |
|---|---|---|---|---|
| 2006/0060228 | A1* | 3/2006 | Yoon et al. | 134/56 D |
| 2006/0174916 | A1 | 8/2006 | Hedstrom | |
| 2008/0248075 | A1 | 10/2008 | Brambilla et al. | |
| 2012/0031442 | A1 | 2/2012 | Plum et al. | |

FOREIGN PATENT DOCUMENTS

| | | | |
|---|---|---|---|
| DE | 10 2005 044622 | A1 | 4/2006 |
| EP | 0 556 776 | A | 8/1993 |
| EP | 0 855 164 | A1 | 7/1998 |
| EP | 1 023 869 | A2 | 8/2000 |
| EP | 2 033 566 | A1 | 3/2009 |
| GB | 1 511 799 | A | 5/1978 |
| GB | 2 144 322 | A | 3/1985 |
| WO | WO 2004/096005 | A1 | 11/2004 |

OTHER PUBLICATIONS

International Search Report and Written Opinion from International Application No. PCT/EP2010/001809, mailed Mar. 23, 2010.
Written Opinion from International Application No. PCT/EP2010/001810, mailed Mar. 23, 2010.
Partial European Search Report from Application No. 09004440, dated Aug. 27, 2009.
Extended European Search Report from Application No. 09004440, dated Oct. 20, 2009.
Extended European Search Report from Application No. 12192994, dated Feb. 7, 2013.
Communications from European Patent Application No. 12192994, dated Dec. 6, 2013.
Extended European Search Report from Application No. 09004439, dated Sep. 15, 2009.

* cited by examiner

DISHWASHER SUMP MEMBER

CROSS REFERENCE TO RELATED APPLICATIONS

This application is a national stage application filed under 35 U.S.C. 371 of International Application No. PCT/EP2010/001810, filed Mar. 23, 2010, which claims priority from European Application No. 09004439.7, filed Mar. 27, 2009, each of which is incorporated herein in its entirety.

The present invention relates to a dishwasher comprising a wash chamber, a water circulation system for passing water into and out of the wash chamber, and a water-collecting sump member which is fastened in a water-tight manner to an opening in a lower end portion of the wash chamber.

Some manufacturers have suggested designing the sump member as a preassembled unit which comprises hydraulic units such as the circulation pump, the drain pump and the like.

Thus, in DE 10 2005 044 622 A1 there is suggested a dishwasher comprising a wash chamber, a water circulation system for passing water into and out of the wash chamber, and a water-collecting sump member which is fastened in a water-tight manner to an opening in a lower end portion of the wash chamber. The sump member comprises as generally bowl-shaped lower portion which is mounted in said opening of the wash chamber, and an upper portion which forms a lid for the bowl-shaped lower portion and which comprises an array of inlet openings through which water from the wash chamber may flow into the sump member. Within the interior volume which is enclosed by the lower and upper portions of the sump member there are provided a number of mechanical or electrical components, such as a heating element for heating the water which is collected in the sump, a water guiding system including a switching valve for distributing circulation water between an upper spray arm and a lower spray arm, an impeller of the circulation pump, a shredder for comminution of larger debris particles etc.

In U.S. 2006/0174916 A1 there is disclosed a dishwasher wherein a plurality of fluid conduits, in particular a wash fluid supply conduit, a wash fluid circulation conduit and a wash fluid drain conduit, is formed along the bottom wall of the wash chamber.

It is an object of the present invention to provide for a dishwasher which facilitates manufacturing of the dishwasher.

In a dishwasher comprising a wash chamber, a water circulation system for passing water into and out of the wash chamber, and a water-collecting sump member which is fastened in a water-tight manner to an opening in a lower end portion of the wash chamber, in accordance with the present invention this object is solved in that the sump member is a self-contained molded plastic unit comprising an upper portion which constitutes an interface for connecting the sump member in a water-tight manner to said opening, and a lower portion comprising a water collecting receptacle, wherein said upper portion comprises at least one integral fitting for connecting the sump member to a water inlet conduit and/or a drain conduit of the dishwasher.

By designing the sump member as a self-contained molded plastic unit, the upper portion of which constitutes an interface for connecting the sump member in a water-tight manner to the opening provided in the washing chamber, wherein the upper portion further comprises one or more integral fittings for connecting the sump member to the water circulation system for passing water into and out of the wash chamber, and particular to one or more water inlet conduits and/or a drain conduit, it is possible to design the sump member as a modular unit which facilitates adapting the sump member to different dishwasher models. While the upper portion of the sump member comprises at least one integral fitting for connecting the sump member to a water inlet conduit or to a drain conduit, the upper portion of the sump member preferably comprises integral fittings for all the various hydraulic connections that are to be established between the sump member and the water circulation system of the dishwasher. Thus, the lower portion of the sump member can be designed as a standard member which can be combined with different versions on the upper portion of the sump member, wherein the sections of the sump member that require customizing, which particularly pertains to the water-tight connection between sump member and wash chamber as well as to the fittings by which the sump member is connected to the water feed and drain conduits, are integrally provided at the upper portion of the sump member. Thus, if for example two dishwasher models shall be manufactured, wherein one shall provide for a larger opening in the bottom of the wash chamber so as to accommodate a larger sieve area, two versions of the upper portion of the sump member can be provided which then are assembled with one and the same version of a sump member lower portion. Thus, the engineering of new dishwasher models is greatly facilitated and overall manufacturing costs decrease.

The dishwasher of the present invention can be any type of dishwasher, i.e. commercial or domestic dishwasher, but preferably is a dishwasher for domestic use.

The sump member is made at least in part, and preferably is made entirely, of plastics material, which plastics material may be a single material or a mixture of two or more materials. In this manner the sump member can be manufactured by injection molding, which is particularly preferred due to its ability to produce, in a single manufacturing operation, also complex components. A particularly preferred material for manufacturing of the sump member is polypropylene, which is particularly suited because it is resistant to alkaline and hot water.

While the sump member and any integrated fittings thus can be manufactured as a single integral part, it should be understood that due to the selected geometry of the sump member it may be necessary or at least recommendable to manufacture parts of the sump member as separate members which in a further manufacturing step are releasably or permanently connected to the sump member.

Preferred embodiments of the present invention are defined in the dependent claims.

Especially when the sump member and particularly the lower portion thereof serves as a mounting platform for electric and/or hydraulic components of the dishwasher, such as a circulation pump, a drain pump, switching elements, sensors, and the like, the lower portion of the sump member can be designed as a standard component to which any such components are attached, so that when a different dishwasher model shall be designed, one only needs to redesign the upper portion of the sump member which comprises the interface to the washing chamber and the fittings for connecting the sump member to the water inlet or drain conduits of the dishwasher. Thus, the lower portion preferably comprises an integral first housing section for accommodating an impeller of a circulation pump and/or an integral second housing section for accommodating an impeller of a drain pump, Preferably the upper portion of the sump member comprises at least one integral fitting for a spray arm feed conduit. In particular, there may be provided a first integral fitting for feeding circulation water to a lower spray arm as well as a second integral fitting for feeding circulation water to an upper spray arm. While in conventional domestic dishwashers there usually are provided a lower and an upper basket, wherein a lower spray arm is located below the lower basket and an upper spray arm is located below the upper basket, in embodiments in which there are provided further spray nozzle arrangements, such as an intermediate spray arm, the upper portion of the sump member comprises further integral fittings for any such additional nozzle arrangement. Furthermore, in embodiments in which there is more than one spray arm to which water is to be fed, the sump member may comprise means for distributing water between the spray arms.

In order to further facilitate manufacturing of the dishwasher, at least one of said integral fittings can be adapted for snap-fit connection to a respective conduit to be connected to said fitting, which snap-fit connection can be adapted either for releasable or for permanent connection.

The upper and lower portions of the sump member either may be connected to each other in a liquid-tight manner, for example by a snap-fit connection, or may comprise integral parts of the sump member, i.e. may be integrally connected to each other such as by welding, gluing or the like.

The upper portion of the sump member preferably comprises a sealing which is adapted for water-tight sealing of corresponding contact areas of said upper portion of the sump member and the opening in the lower end portion of the wash chamber.

In preferred embodiments of the present invention the sump member comprises at least one integrated passage that is formed at least in part integrally with the sump member for passing water to at least one hydraulic component of the dishwasher. By integrating a passage via which water can be passed to at least one hydraulic component of the dishwasher, not only the integrity of the assembly is improved, i.e. less components have to be manufactured and assembled, but also the product safety is improved, because less fittings, sealings and the like are required to connect the water inlet to the water softening device.

Thus, the sump member preferably comprises a plurality of integrated passages which may be provided for connecting various hydraulic components of the dishwasher, such as a water softening device, a salt tank for storing a salt solution for regeneration of the water softening device, a water distribution system including a circulation pump for passing cleaning liquid to spray nozzles within the wash chamber, a drain pump for draining the sump to a waste water outlet, a mains inlet tube for feeding fresh water into the dishwasher, filter elements for filtering dirt particles from the cleaning liquid circulated within the dishwasher, a water-collecting space of the sump, etc. The integrated passages may extend into and in part within the respective hydraulic component or they may extend to or from an inlet or outlet opening of the respective hydraulic component. Furthermore, any of the integrated passages can be equipped with a backflow protection device, so as to ensure that liquid flowing through the integrated passage only can flow in a certain predetermined direction.

The integrated passages can comprise channels and/or openings which are provided in the upper and/or lower portion of the sump member. Thus, particularly if the upper portion of the sump member constitutes a cover member for vessel portions of the lower member, such as a water-collecting receptacle of the sump member, an ion exchange material tank or a salt tank, the cover member can comprise integrally formed passages for passing liquid from one section of the cover member to another section of the cover member, where an opening is provided within the cover member, so as to allow any liquid flowing through the passage to pass through the opining and into the respective section of the lower portion of the sump member. Furthermore, when the lower portion of the sump member is designed to constitute vessel sections through which liquid is to be passed, such as an ion exchange material tank which is to be filled with a water softening material, such as a softener resin, through which the water to be passed to the spraying nozzles is fed, or a salt tank which is to be filled with a regeneration salt and through which water is fed so as to prepare a salt solution for regeneration of the ion exchange material, the integrated passages can comprise essentially vertically oriented channels having an inlet or outlet opening which opens close to the bottom of the respective vessel section in which the passage is provided. When the integrated passage comprises an essentially vertically oriented channel, this channel can be an integrally formed part of an essentially vertical side wall of the respective vessel section. Furthermore, the inlet and/or outlet openings of the integrated passages can be provided with a sieve structure to retain particles such as ion exchange material or salt particles in specific sections of the sump member.

In preferred embodiments of the present invention the at least one hydraulic component of the dishwasher and the at least one integrated passage of the sump member for passing water to said hydraulic component are selected from the group consisting of:

- an ion exchange material tank of a water softening device for accommodating an ion exchange material and an integrated first passage for passing water from a water inlet, which preferably is connected to the mains inlet tube of the dishwasher, to said ion exchange material tank;
- a salt tank of a water softening device for accommodating a salt solution for the regeneration of said ion exchange material and an integrated second passage for passing water from a water inlet to said salt tank, wherein the integrated second passage of the sump member preferably is connected to the mains inlet tube of the dishwasher, i.e. is fed with fresh water that comes directly from the water inlet of the dishwasher, such as a tap to which the dishwasher is connected, or in the alternative, the integrated second passage receives mains water from a regeneration dosing device which is provided in the dishwasher, which regeneration dosing device can comprises a separate water storage tank for regeneration water, which storage tank receives water from the mains inlet tube and is connected to the integrated second passage;
- an ion exchange material tank of a water softening device for accommodating an ion exchange material and an integrated third passage for passing water from said ion exchange material tank to said wash chamber;
- an ion exchange material tank of a water softening device for accommodating an ion exchange material and an integrated third passage for passing water from said ion exchange material tank to a water collecting space of the sump;
- an ion exchange material tank of a water softening device for accommodating an ion exchange material and a salt tank for accommodating a salt solution for the regeneration of said ion exchange material, and an integrated fourth passage for passing salt solution from said salt tank to said ion exchange material tank, wherein the fourth passage preferably is connected to an inlet opening for salt solution of the ion exchange material tank, or in the alternative, is connected to the inlet opening for mains water of the ion exchange material tank, and wherein further the fourth passage can comprise a back-flow protection device;

a circulation pump and an integrated fifth passage for passing circulation water from the sump to the circulation pump, which integrated fifth passage thus may extend from an outlet opening of the sump member for circulation water, i.e. for cleaning liquid that is circulated through the wash chamber, to an inlet opening of the circulation pump, i.e. a port of the circulation pump which is arranged on the suction side of such pump;

a circulation pump and a water distribution system and an integrated sixth passage for passing pressurized circulation water from said circulation pump to said water distribution system, wherein the integrated sixth passage of the sump member thus can extend from a circulation water outlet opening of the circulation pump which is located on the pressure side of the circulation pump to an inlet opening of a circulation water distribution system for providing pressurized circulation water to spray arms provided within the wash chamber;

a drain pump and an integrated seventh passage for passing waste water from the sump to said drain pump, wherein the integrated seventh passage thus can extend from an outlet opening of the sump member for waste water which preferably is arranged in a water-collecting bottom region of the sump member, to an inlet opening of the drain pump for waste water which is arranged on the suction side of the drain pump;

a drain pump and a drain tube and an integrated eighth passage for passing pressurized waste water from said drain pump to said drain tube, wherein the integrated eighth passage can extend from an outlet opening of the drain pump for waste water, i.e. a pump port which is arranged on the pressure side of the drain pump, to an inlet opening for waste water of the drain tube, and wherein the eighth passage and/or the drain tube preferably are equipped with a backflow protection device, and an ion exchange material tank of a water softening device for accommodating an ion exchange material and a circulation pump, and an integrated first passage for passing water from a water inlet to said ion exchange material tank and an integrated ninth passage which branches off from the first passage upstream of the ion exchange material tank for passing at least a portion of the water passing through the first passage into one of said wash chamber and a water collecting space of the sump member. With the integrated first passage passing water from the water inlet to the water softening device, the ninth passage thus forms a bypass for passing at least a portion of such water into the wash chamber or into the water collecting space of the sump member, instead of first passing such water through the water softening device. The integrated bypass of the sump member thus can extent from a branch-off opening formed in the integrated first passage to an inlet opening for mains water of the wash chamber or of the water collecting space of the sump member. In order to control the amount of water which is passed to the water softening device and through the bypass, respectively, valve means can be provided in the integrated first passage, in the integrated ninth passage or at the point where the ninth passage branches off from the first passage, which valve means is controllable by a setting device, particularly a setting device which can be set manually and/or by an automatic control device of the dishwasher to take into account local water hardness and/or which is adjusted by the automatic control device according to a water hardness measurement which is performed by a water hardness sensor of the dishwasher, in particular by a conductivity sensor.

If a regeneration dosing device is employed, it preferably is connected to the mains inlet tube via a back-flow safety device, such as an air brake, wherein the regeneration dosing device is provided in its upper portion with a water inlet tube having an arched section that is located at a higher level than the water within the regeneration dosing device, so that water which is provided under pressure from the mains inlet tube can enter the regeneration dosing device, but water from the regeneration dosing device cannot flow back into the mains inlet tube.

In embodiments in which the sump member comprises one or more integrated passages, the upper portion of the sump member preferably comprises a generally flat sandwich-type structure comprising an upper sandwich component and a lower sandwich component which enclose an intermediate space therebetween forming at least part of said at least one integrated passage. The upper and the lower sandwich components thus can be arranged essentially horizontally and above each other, wherein the intermediate space between the upper and the lower sandwich components can comprise a plurality of essentially vertical wall sections. Any of the integrated passages of the sump member thus can be defined by two neighboring essentially vertical wall sections which are provided either on one or on both the upper sandwich component and lower sandwich component. In order to provide for a fluid tight connection between the upper and the lower sandwich components particularly in those areas where integrated passages are provided, the upper and lower sandwich components can be connected to each other by gluing or welding.

In further preferred embodiments of the present invention the sump member comprises at least one fixation element for fixation of an electronic or electromechanical device to the sump member, wherein the fixation element preferably is formed at least in part of a plastics material as an integral part of the sump member. Such a fixation element can be adapted for example for fixation of a flow control device such as valves, pressure switches and the like, a water heating device, in particular for heating the circulation water, of the circulation pump, of the drain pump, and/or of at least one sensor, e.g. a temperature sensor, a turbidity sensor for the optical turbidity of water, a water hardness sensor, a water pressure sensor, a water conductivity sensor, a water level sensor and the like. In embodiments in which only part of the electronic or electromechanical device is to be arranged in liquid contact with a respective section of the sump member, as applies for example for a turbidity sensor of which a measuring probe is located within a section of the sump member which during operation of the dishwasher at least temporarily is filled with liquid, whereas further parts of the sensor, such as the electrical contacts are to be located outside the liquid filled section, the fixation element preferably comprises a liquid sealing through which the electronic or electromechanical device extends. In embodiments in which fixation elements are provided for attaching a water heating device for heating the circulation water, such fixation elements preferably are provided in the sump member, in particular in the water collecting receptacle of the sump member. Alternatively or additionally, a water heating element could also be fixed by means of respective fixation element inside the housing of the circulation pump, and particularly in the section where the impeller of such pump is located.

In preferred embodiments of the present invention the lower portion of the sump member further comprises at least one of an ion exchange material tank and a salt tank, and wherein the upper portion of the sump member extends at least over a portion of said water-collecting receptacle, said ion exchange material tank and/or said salt tank. The ion exchange material tank and/or the salt tank can be formed at least in part of plastics material either as an integrally formed part of the lower portion of the sump member, or as a separate member which is assembled with the section of the sump member lower portion comprising the water collecting receptacle.

While thus the water-collecting receptacle of the sump member, the ion exchange material tank and the salt tank can be separately formed parts which in a subsequent manufacturing step are joined together, these components may also comprise a single integral unit which is formed for example by injection molding of a plastics material. Similarly, also the upper portion which forms a cover for at least a portion of the water-collecting receptacle, a cover for at least a portion of the said ion exchange material tank and/or a cover for at least a portion of the said salt tank, can be separately formed parts which in a subsequent manufacturing step are joined together. Preferably, also such cover components comprise a single integral unit which is formed for example by injection molding of a plastics material. Furthermore, in such embodiments, the cover member preferably is adapted for liquid-tight fixation of the sump member to the opening in the lower end portion of the wash chamber, such as by comprising a sealing which is adapted for water-tight sealing of respective contact areas of the sump cover member and the lower end portion of the wash chamber. In embodiments in which there is provided a slat tank, the portion of the cover member which forms a cover for the salt tank preferably is provided with a salt fill opening through which a regenerating salt for forming a salt solution for the regeneration of the ion exchange material can be filled into the salt tank. The salt fill opening preferably comprises a water-tight closure, in particular a water-tight screw cap.

In preferred embodiments of the present invention a filter sieve is provided in the opening in the lower end portion of the wash chamber, which filter sieve serves for filtering dirt particles out of the circulation water when it drips off from the articles to be cleaned within the wash chamber and flows down towards the water-collecting receptacle of the sump. As in conventional dishwashers, the filter sieve preferably comprises a first generally flat but funnel-shaped filter element, as well as a second generally tubular filter element which is arranged vertically within the water-collecting receptacle of the sump. When the sump member is fastened to the opening in the lower end portion of the wash chamber, the sump member cover preferably is arranged below at least an essentially horizontal flat part of the filter sieve. If the filter sieve is made of stainless-steel and the dishwasher comprises a water softening device comprising a salt tank, the salt fill opening preferably is arranged such that direct contact between the flat filter sieve and an occasional spill of salt solution that may occur during filling of the regenerating salt into the salt fill opening is avoided. In contrast to conventional dishwashers, in which the salt fill opening is provided in the tub bottom aside the flat filter sieve, in the dishwasher suggested herein the salt fill opening preferably located below the flat filter sieve in the cover member of the sump member. With the sump member and thus also the cover member preferably being made of plastics material, the risk of corrosion due to inadvertent spill of salt in the region of the salt fill opening is avoided. For this reason, in the dishwasher suggested herein the tub bottom need not be manufactured from highly corrosion resistant stainless steel, such as austenitic steel, but can also be made of materials comprising less corrosion resistance, such as ferritic stainless steel.

Preferred embodiments of the present invention are described in further detail below by reference to the accompanying drawings, in which.

Figure 1:
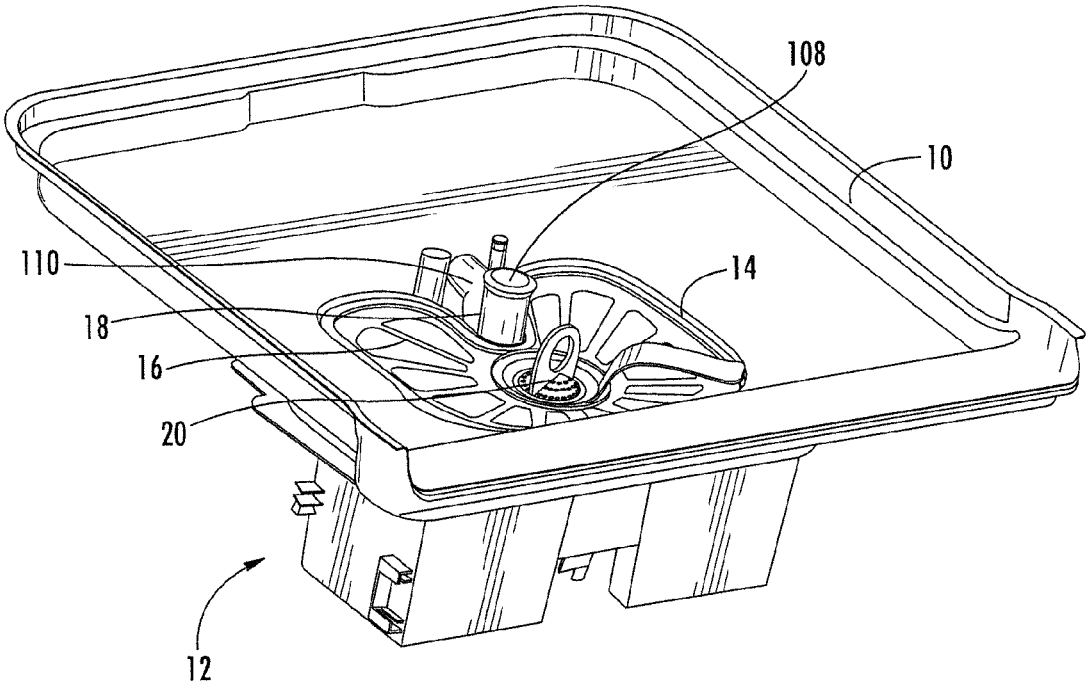
FIG. 1 is a perspective view of a sump member according to the present invention when assembled to a tub bottom of a wash chamber of a dishwasher.

In FIG. 1 there is shown a tub bottom 10 of a dishwasher, which particularly may be a domestic dishwasher which typically has two dishwasher baskets into which articles to be washed can be loaded, wherein rotatable spray arms are provided in the wash chamber of the dish washer so as to spray a cleaning liquid onto the articles to be washed. Tub bottom 10, which may a stainless steel member, is a generally flat but funnel-shaped member having at about its centre an opening 14 below which a sump member, generally designated with 12, is located. Sump member 12 comprises a water collection receptacle as will be further explained below by reference to FIGS. 3 to 6. In order to prevent dirt particles from entering the water collection receptacle of the sump, a generally flat but funnel-shaped filter element 16, which preferably is a stainless steel member, is located within opening 14 of tub bottom 10. Additionally, a generally tubular fine filter 20 is arranged in the center portion of filter element 16.

A spray arm support 18 projects upwardly from the sump member 12. Spray arm support 18 comprises a hub 108 for a rotatable spray arm and a tubing section 110 which provides for a connection to an upper spray arm so as to provide cleaning liquid to the spray arms.

Figure 2:
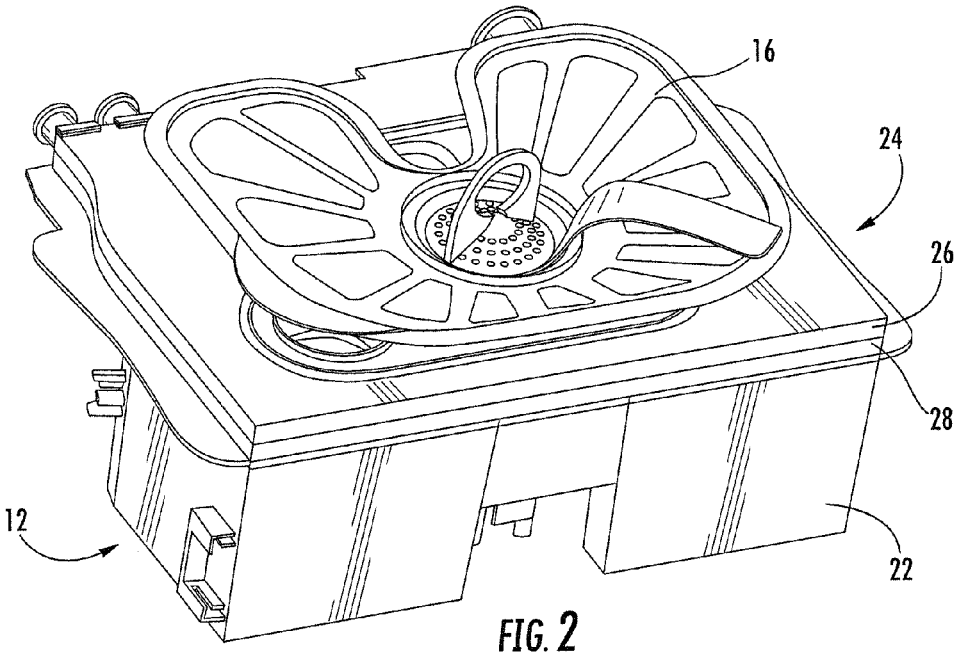
FIG. 2 is a perspective view of the sump member of FIG. 1, in which for purpose of illustration the tub bottom and the support for the lower spray arm has been removed.

FIG. 2 shows the sump member 12 of FIG. 1 in a slightly enlarged view and with the tub bottom 10 and the spray arm support 18 being removed. As can be seen in FIG. 2, sump member 12 comprises a lower part 22 and an upper part, which generally is designated with 24. Whereas lower part 22 of sump member 12 comprises several vessel sections for collecting or retaining liquid volumes, as will be further explained below by reference to FIGS. 5 and 6, upper part 24 of sump member 12 is a generally flat member, which constitutes a cover member for lower part 22 of the sump member. Sump member upper part 24, which also is designated herein as "cover member", comprises a generally flat sandwich-type structure comprising an upper sandwich component 26 and a lower sandwich component 28. Upper sandwich component 26 and lower sandwich component 28 enclose an intermediate space therebetween within which a plurality of integral passages is formed as will be explained below particularly by reference to FIG. 4.

Figure 3:
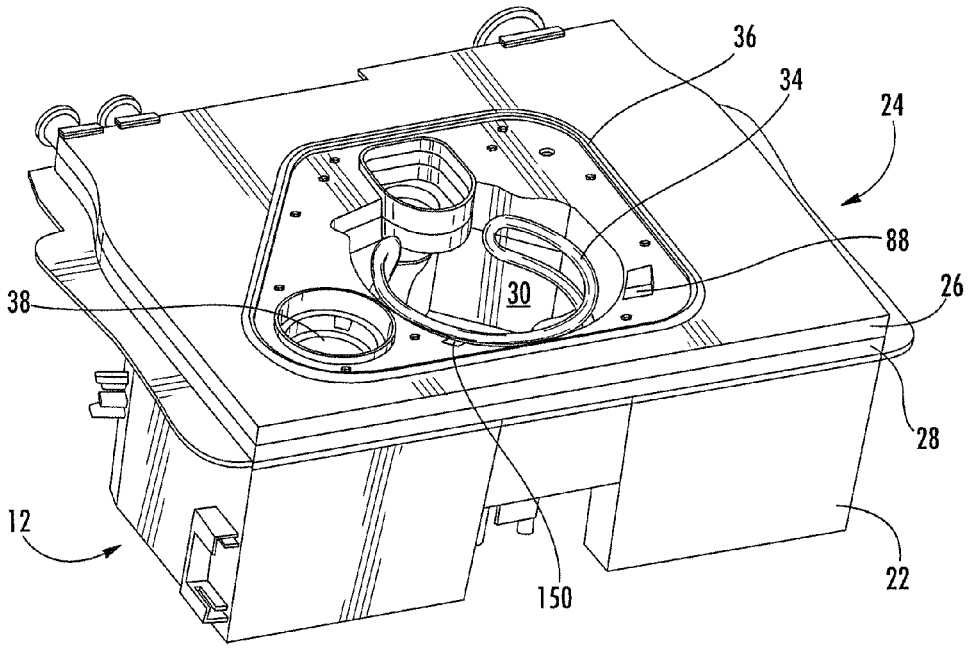
FIG. 3 is a perspective view of the sump member of FIG. 2, in which for purpose of illustration the filter elements that are shown in FIG. 2 were removed.

FIG. 3 is a view similar to FIG. 2, wherein, however, flat filter 16 and fine filter 20 are not shown, so as to provide a free view onto the upper sandwich component 26 of the upper part 24 of sump member 12. In the central portion of upper part 24 there is provided an opening 30, which provides for an access to a water collecting receptacle 32 (see FIGS. 4, 6 and 7) provided in the lower part 22 of sump member 12. Within the water collecting receptacle 32 in which in the assembled state of the dishwasher there is provided fine filter 20, there further is provided an electric heating element 34, which comprises a plurality of heating coils, which are provided in an annular configuration, so as to surround fine filter 20. On the upper side of upper sandwich component 26 there is provided a reception groove 36 for a sealing element, which in the assembled state of the dishwasher rests against the underside of tub bottom 10, so as to provide for a fluid-tight sealing between tub bottom 10 and sump member 12, so that water which collects in the tub bottom and flows through the opening 14 in tub bottom 10, is prevented from leaking outwardly, but rather is directed to the water collecting receptacle 32.

In the upper portion 24 of the sump member there further is provided a salt fill opening 38, which communicates with a salt tank 56 provided in the lower portion 22 of sump member 12, as will be explained in further detail below by reference to FIGS. 6 and 7. Along its inner circumference, salt fill opening 38 is provided with engagement means, such as threads or recesses for fixing a removable cap within salt fill opening 38, which cap thus can be screwed into salt fill opening 38 or is held therein by means of a bayonet connection.

Figure 4:
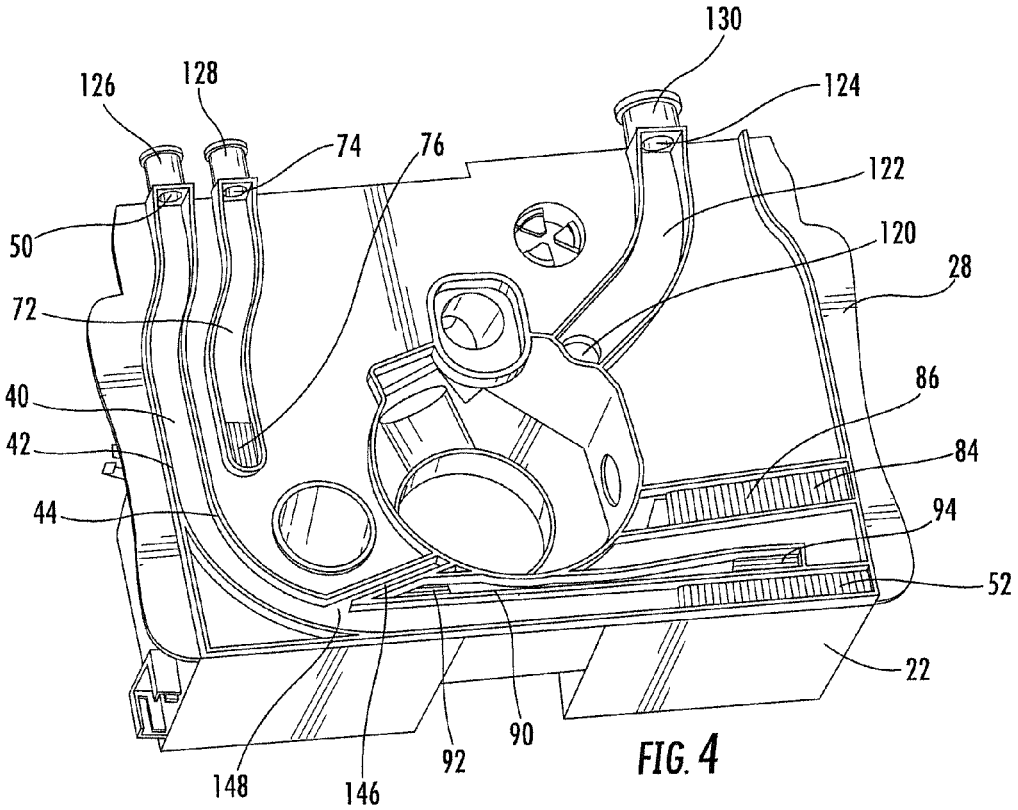
FIG. 4 is a perspective view of the sump member of FIG. 3, in which for purpose of illustration the upper portion of the sandwich-type cover member has been removed.
Figure 5:
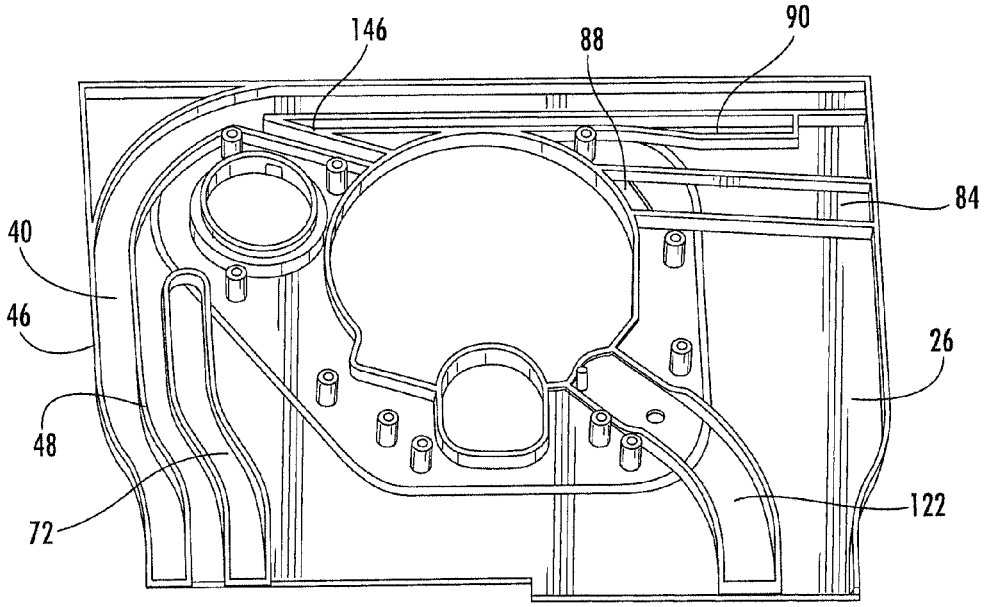
FIG. 5 is a perspective view of the upper portion of the sandwich-type cover member when viewed from below.
Figure 6:
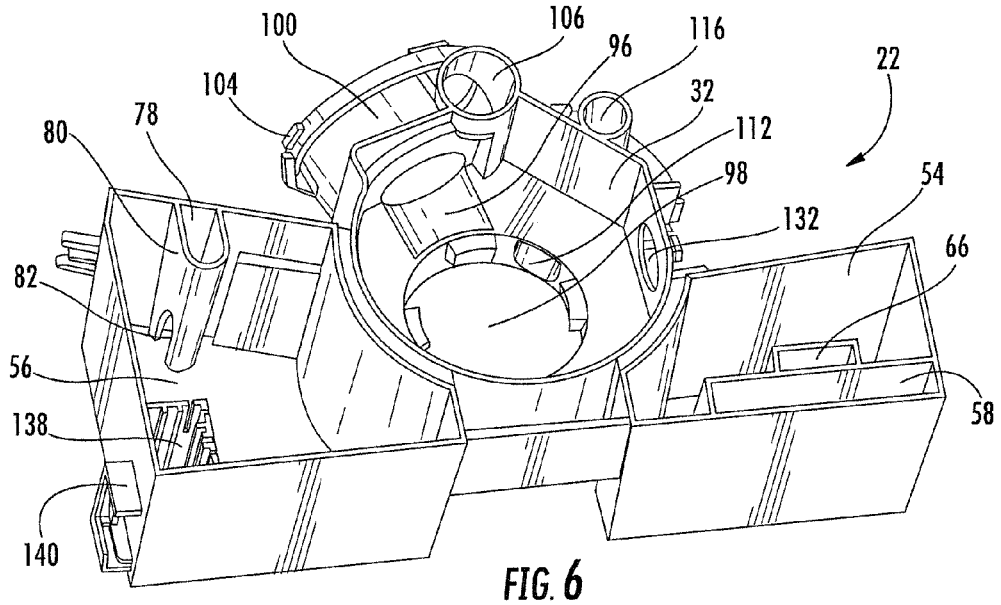
FIG. 6 is a perspective view of the lower portion of the sump member.
Figure 7:
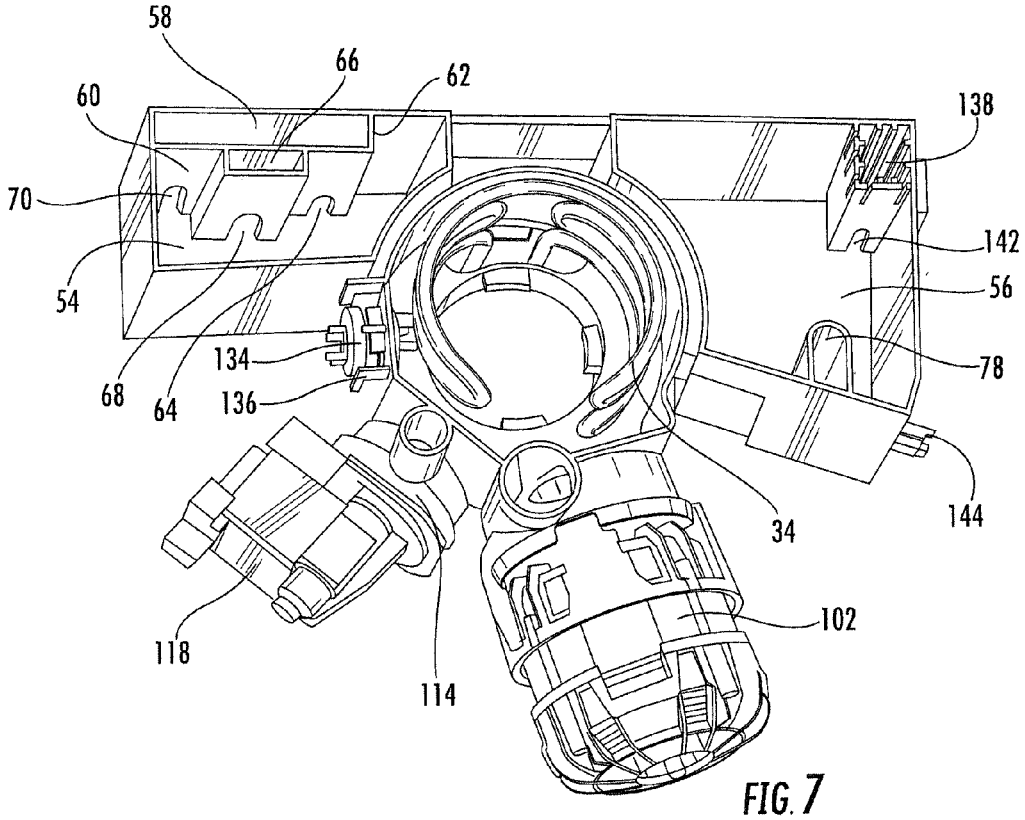
FIG. 7 is a further perspective view of the lower portion of the sump member from a different point of view and additionally illustrates further components of the dishwasher when mounted to the lower portion of the sump member.

Sump member 12 provides for various connections between hydraulic parts of the dishwasher, as will be explained by reference to FIGS. 4 to 7, wherein FIG. 4 is a perspective view of sump member 12, wherein upper sandwich component 26 of the upper part 24 of sump member 12 has been removed, so as to give a clear view onto the upper side of lower sandwich component 28, FIG. 5 is a perspective view of the upper sandwich component 28 when viewed from below, and FIGS. 6 and 7 illustrate the lower part 22 of the sump member 12 from different viewpoints.

A plurality of passages is formed in the intermediate space between the upper side of lower sandwich component 28 and the lower side of upper sandwich component 26. Thus, a first passageway 40 is formed between a first and a second vertical wall 42 and 44 of lower sandwich component 28 and corresponding first and second walls 46 and 48 provided at the lower side of upper sandwich component 26. When upper sandwich component 26 is placed onto lower sandwich component 28, the first vertical wall 46 of upper sandwich component 26 will rest on first vertical wall 42 of lower sandwich component 28. Correspondingly, second vertical wall 48 of lower sandwich component 26 will rest on second vertical wall 44 of lower sandwich component 28. In order to provide for a fluid-tight connection between upper and lower sandwich components 28 and 26, these components can be combined by gluing, welding or the like. In the assembled state, passageway 40 thus is a curved closed channel that is confined by an outer vertical wall formed by vertical walls 42, 46, an inner vertical wall formed by vertical walls 44, 48 a bottom wall that is provided by the upper side of lower sandwich component 28 as well as a top wall that is provided by the lower side of upper sandwich component 26. All the other passages, by which hydraulic components of the dishwasher are connected, as will be explained in further detail below, are formed in a similar manner. First passageway 40 extends from a water inlet 50 to an opening 52 within lower sandwich component 28 through which water flowing through first passageway 40 can pass through lower sandwich component 28 into a section of lower part 22 of sump member 12.

As is illustrated particularly in FIGS. 6 and 7, lower part 22 of sump member 12 comprises several vessel sections, namely a water collecting receptacle 32, an ion exchange material tank 54 and a salt tank 56. Within the ion exchange material tank 54 an essentially vertically oriented channel 58 is formed by means of vertical side walls 60 and 62. When sump member 12 is assembled, vertical channel 58 is located below opening 52 in lower sandwich member 28, so as to communicate with first passageway 40. At its lower end, vertical channel 58 opens into the ion exchange material tank 54 by means of openings 64 and 70, which are provided in vertical side wall 60. First passageway 40, opening 52, vertical channel 58 and openings 64 and 70 thus constitute a conduit (herein also referred to as "$1^{st}$ passage") for passing water from water inlet 50 into ion exchange material tank 54.

Referring again to FIGS. 4 and 5, further vertical walls are provided at the upper side of lower sandwich member 28 and at the lower side of upper sandwich component 26, so as to form a second passageway 72, which extends from a water inlet 74 to an opening 76 provided in lower sandwich component 28. Opening 76 communicates with a vertical channel 78, which is formed by a vertical wall member 80, which is provided within salt tank 56. Vertical channel 78 opens into salt tank 56 via an opening 82, which is provided in wall member 80. Second passageway 72, opening 76, vertical channel 78 and opening 82 thus constitute a conduit (herein also referred to as "$2^{nd}$ passage") for passing water from water inlet 74 into salt tank 56.

A third passageway 84 is provided within sump member upper part 24, which third passageway 84 extends from an opening 86 within lower sandwich component 28, which opening 86 is located above ion exchange material tank 54, to an outlet opening 88, which is provided in the upper sandwich component 26 (see FIGS. 3 and 5). Opening 86, passageway 84 and outlet opening 88 thus constitute a conduit (herein also referred to as "$3^{rd}$ passage") for passing water from ion exchange material tank 54 the washing chamber or into the water collecting receptacle 30 of the sump.

During operation of the dishwasher, water thus can be fed via inlet opening 50 and through the $1^{st}$ passage 40 into the ion exchange material tank so as to be softened therein by action of an ion exchange material, such as a softener resin, from which the softened water will be flowed out via opening 86 into third passage 84, from which the softened water exits via the $3^{rd}$ passage, so as to flow into the washing chamber or into the water collecting receptacle 30 of the sump, from which the softened water can be passed via a circulation pump to spray arms located within the dishwasher.

In order to regenerate the ion exchange material within tank 54 a salt solution can be passed through the ion exchange material tank 54, which salt solution is prepared within salt tank 56. To this end, a fourth passageway 90 is provided in the upper part 24 of sump member 12 by further vertical walls provided at the upper end lower sandwich component 26, 28. Fourth passage 90 comprises an inlet opening 92 through which salt solution from salt container 56 can flow into the fourth passageway 90, as well as an outlet opening 94, which connects to a vertical channel 66 provided within ion exchange material tank 54 and which opens via an opening 58 into the bottom of ion exchange material tank 54. Opening 92 of salt tank 54, fourth passageway 90, outlet opening 94, vertical channel 66 and opening 58 thus constitute a conduit (herein also referred to as "4$^{th}$ passage") for passing water from salt tank 56 into ion exchange material tank 54. Thus, if the ion exchange material within tank 54 is to be regenerated, water is passed via water inlet 74 and the 2$^{nd}$ passage into salt tank 56 so as to form a salt solution. By passing additional water into salt tank 56 the already prepared salt solution is displaced from salt tank 56 and is passed via the 4$^{th}$ passage into ion exchange material tank 54.

As is shown in FIGS. 4 and 5, a ninth passageway 146 is provided in the upper part 24 of sump member 12. Ninth passageway 146 branches off from a side-opening 148 of first passageway 40 and extends to an opening 150 provided in upper sandwich component 26 of sump member upper part 24. By means of the ninth passageway 146 a portion of the water that is passed from water inlet 50 to the water softening device, i.e. to ion exchange material tank 54, is fed directly into the sump and thus bypasses the ion exchange material tank 54. In order to adjust the amounts of water that is passed to the ion exchange material tank and is fed directly into the sump of the dishwasher, valve means can be provided preferably at point 148, where the ninth passageway 146 branches off from first passageway 40.

As shown in FIG. 6, a fifth passageway 96 is provided in the lower part 22 of sump member 12, which passageway has an opening close to the bottom 98 of water collecting receptacle 32 and extends to a first annular housing section 100. First annular housing section 100 is adapted to accommodate the impeller of a circulation pump 102 (shown in FIG. 7) which can be attached to housing section 100 by means of fixations 104 which engage respective projections provided at circulation pump 102. Lower part 22 of sump member 12 further comprises a sixth passageway 106 which comprises an outlet of annular housing section 100 through which water, which by action of the impeller of circulation pump 100 is withdrawn from bottom 98 of water collecting receptacle 32, is passed via an opening 107 in both the lower sandwich component 28 and upper sandwich component 26 of sump member upper part 24 to a water distribution system which feeds the spray arms that are located within the wash chamber. In this manner, circulation pump 102 feeds circulation water to spray arm support 18 shown in FIG. 1, from which water is passed to via tubing section 108 to a lower spray arm and water is passed via tubing section 110 to an upper spray arm.

While fifth passageway 96 and its respective openings into water collecting receptacle 32 and annular housing section 100 thus constitute a conduit (herein also referred to as "5$^{th}$ passage") for passing water from the sump member to the circulation pump 102, outlet 106 of annular housing section 100, opening 107 and tubing sections 108 and 110 of spray arm support 18 constitute a conduit (herein also referred to as "6$^{th}$ passage") for passing water from the circulation pump 102 to the spraying nozzles.

A lower part 22 of sump member 12 furthermore comprises a seventh passageway 112, which opens close to the bottom 98 of water collecting receptacle 32. Seventh passageway 112 leads into a second annular housing section 114, which is adapted to accommodate the impeller of a drain pump 118, which is mounted to sump member lower part 22 by means of respective fixations provided at second annular housing section 114. Second annular housing section 114 in an upper section thereof comprises an outlet 116, through which water that is withdrawn by the action of drain pump 118 from the bottom of water collecting receptacle 32 is passed upwards to an opening 120 provided in lower sandwich component 28 of sump member upper part 24. As shown in FIG. 4, opening 120 opens into an eighth passageway 122, which is provided by corresponding vertical wall sections provided on the upper side of lower sandwich component 28 and on the lower side of upper sandwich component 26. Eighth passageway 122 leads to an outlet opening 124.

While seventh passageway 112 and its respective openings into water collecting receptacle 32 and annular housing section 114 thus constitute a conduit (herein also referred to as "7$^{th}$ passage") for passing water from the sump member to the drain pump 118, outlet 116 of annular housing section 114, opening 120 and eighth passageway 122 constitute a conduit (herein also referred to as "8$^{th}$ passage") for passing waste water from the drain pump 118 to a drain tube of the dishwasher.

In order to connect sump member 12 to respective water inlet and water outlet lines of the dishwasher, such as a mains inlet tube for feeding fresh tap water into the dishwasher, or a drain tube for passing waste water to a domestic drain, sump member 12 preferably is provided with respective flange portions. In particular, as is shown in FIG. 4, sump member upper part 24 can be provided with flange elements 126, 128 and 130, which in the embodiment shown in FIG. 4 can be provided as an integral part of lower sandwich component 28 but which alternatively could also be provided at upper sandwich component 26, wherein flange element 126 communicates with water inlet opening 50 of first passageway 40, flange element 128 communicates with water inlet opening 74 of second passageway 72 and flange element 130 communicates with outlet opening 124 of eighth passageway 122.

As is shown in FIGS. 6 and 7, sump member 12 can be provided with further fixations, where additional hydraulic, electric or electronic components of the dishwasher can be attached. Thus, as is shown in FIGS. 6 and 7, sump member lower part 22 can comprise an opening 132, which is provided in a wall of water collecting receptacle 32, at which opening 132 a turbidity sensor 134 is mounted. Turbidity sensor 134 is held at lower part 22 of sump member 12 by means of fixation elements 136 which are integrally formed at the exterior side of the wall of water collecting receptacle 32. By means of turbidity sensor 134 the water quality within the sump can be measured, so as to adapt the washing cycle carried-out in the dishwasher.

As is shown in FIG. 6, lower part 22 of sump member 12 further comprises a housing section 138 adjacent salt tank 56, which housing section 138 is adapted to accommodate a float of a reed switch, which can be attached to sump member lower part 22 at a fixation 140 provided on the exterior side of sump member lower part 22. Housing section 138, in a lower section thereof, comprises an opening 124 towards salt tank 56, so that the liquid level within housing section 138 at all times will correspond to the liquid level within salt tank 56. In this manner a reed switch that is attached to fixation 140 can measure the filling level within salt tank 56 by detecting the position of the reed float floating on the liquid within housing section 138.

Sump member 12 further can be provided with further integral fixations such as fixation 144 shown in FIG. 7, which may be used either for attaching further components to the sump member or for mounting the sump member itself within the dishwasher.

Figure 8:
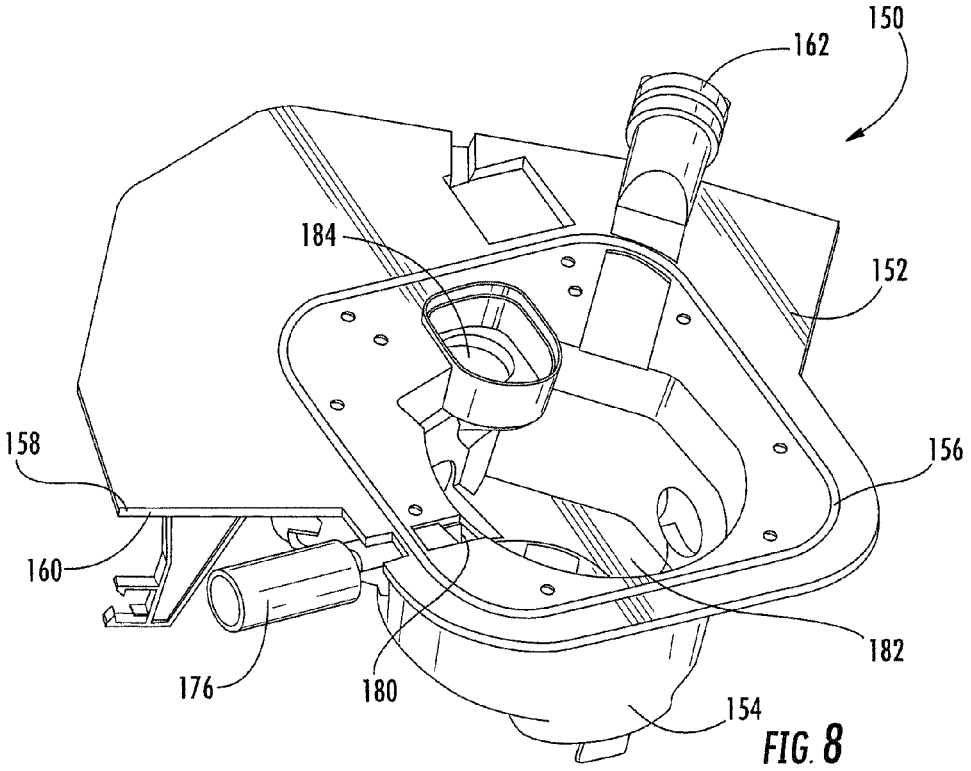
FIG. 8 is a perspective view of a sump member in accordance with another preferred embodiment.
Figure 9:
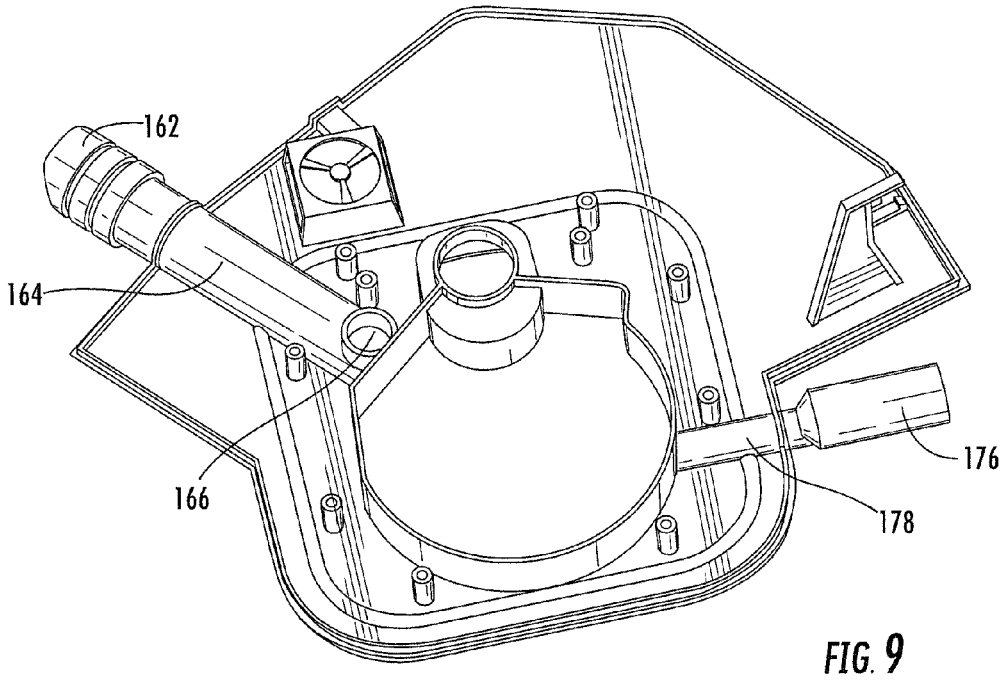
FIG. 9 is a perspective view of the upper portion of the sump member of FIG. 8 when viewed from below.

By reference to FIGS. 8 to 13 a further embodiment of the sump member of the dishwasher suggested herein is described below. FIG. 8 is a perspective view of a sump member 150 comprising an upper part 152 and a lower part 154. Similar as sump member 12 shown in FIG. 1, sump member 150 is adapted to be sealingly mounted to a tub bottom 10, to which end sump member upper part 152 comprises a reception groove 156 for accommodating a sealing member, which in the assembled state of the dishwasher rests against the bottom side of tub bottom 10.

Figure 10:
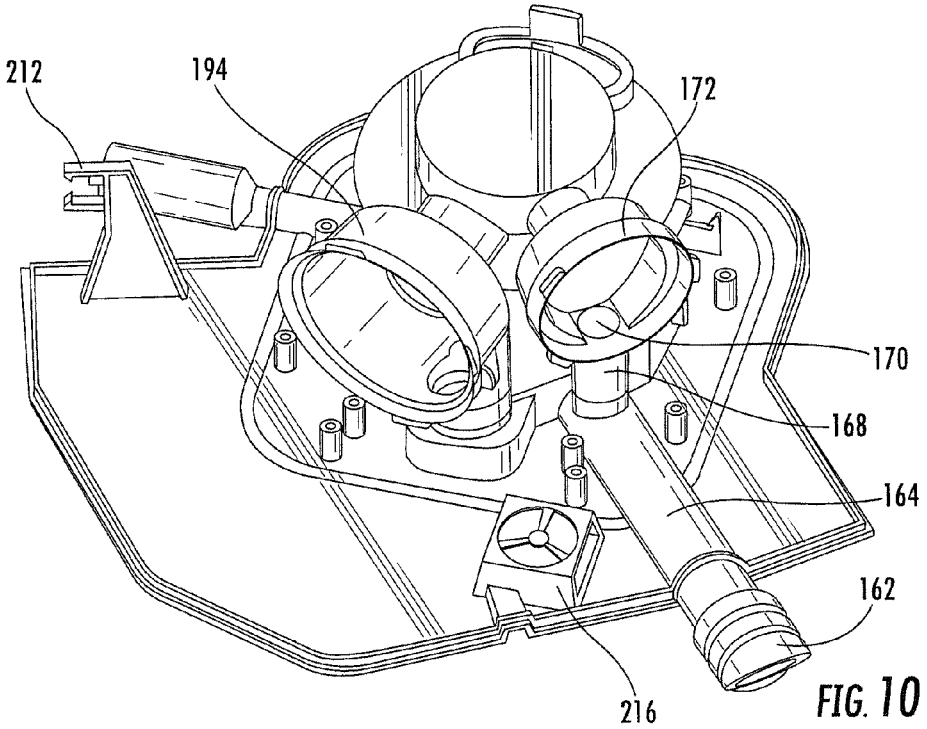
FIG. 10 is a perspective view of the sump member of FIG. 8 when viewed from below.

Upper portion 152 of sump member 150 is a sandwich type element comprising an upper sandwich component 158 and a lower sandwich component 160. Similarly as in the first embodiment, also in the second embodiment shown in FIGS. 8 to 13, the sump member comprises a plurality of integrally formed passages which provide for a hydraulic connection between individual components of the dishwasher. In particular, upper portion 152 of sump member 150 comprises an integrally formed fitting 162 for connecting a drain tube (not shown) to a passageway 164 which is integrally formed in sump member upper portion 152. Passage 164 leads to an opening 166 which in the assembled state of the sump member, as it is shown in FIG. 10, connects to a vertical passage 168 that is integrally provided at sump member lower portion 154. Passage 168 opens via an opening 170 into a housing section 172, which is integrally formed at sump member lower portion 154 and which is adapted to accommodate the impeller of a drained pump 174 (see FIG. 11).

Sump member upper part 152 further comprises an integral fitting 176 for connecting a water inlet tube (not shown) to sump member 150, so as to feed fresh water from a mains inlet tube to a passage 178 which is integrally provided in sump member upper part 152 and which comprises an opening 180 via which fresh water can be directed into the washing chamber or the water collecting receptacle 182 provided in sump member lower part 154.

Figure 11:
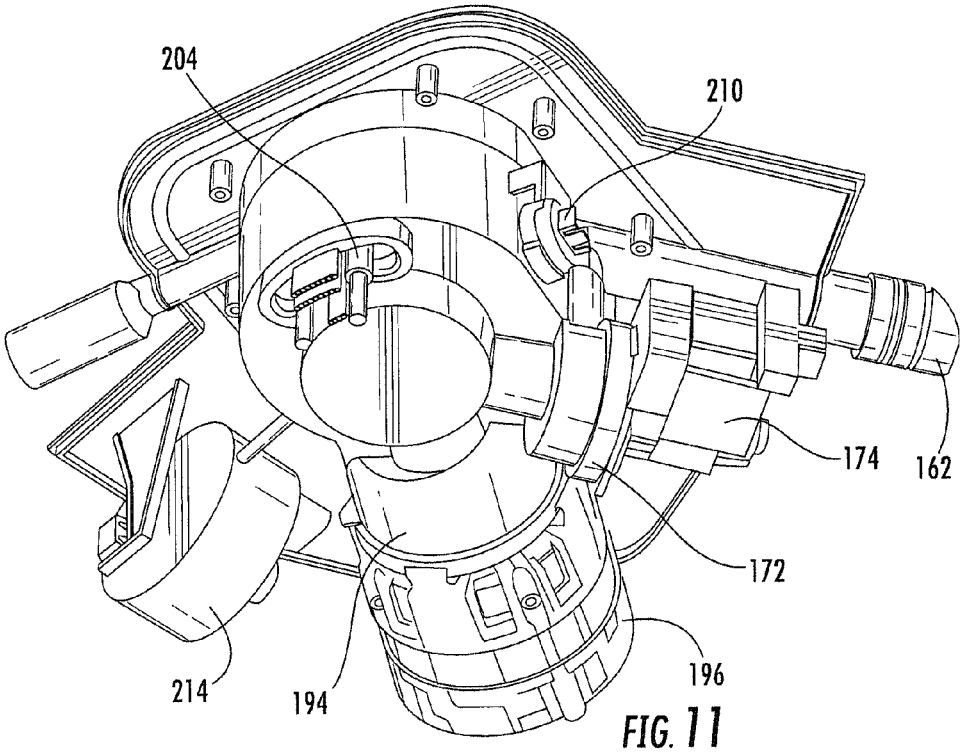
FIG. 11 is a perspective view of the sump member of FIG. 8 when viewed from below, wherein further components of the dishwasher are illustrated which are mounted to the lower portion of the sump member.

As can be seen in FIG. 8, sump member upper part 152 further comprises an outlet opening 184 in which in the assembled state of the dishwasher a spray arm support 186 (FIG. 13) is mounted. Spray arm support 186 distributes circulation liquid between a lower spray arm support feed conduit 188 and an upper spray arm feed conduit 190. In the assembled state of the sump member, outlet opening 184 connects to a vertical passage 192 (FIG. 12) provided in the lower part 154 of sump member 150, which passage 192 connects outlet opening 184 to a housing section 194, which is adapted to accommodate the impeller of a circulation pump 196 (FIG. 11).

Figure 12:
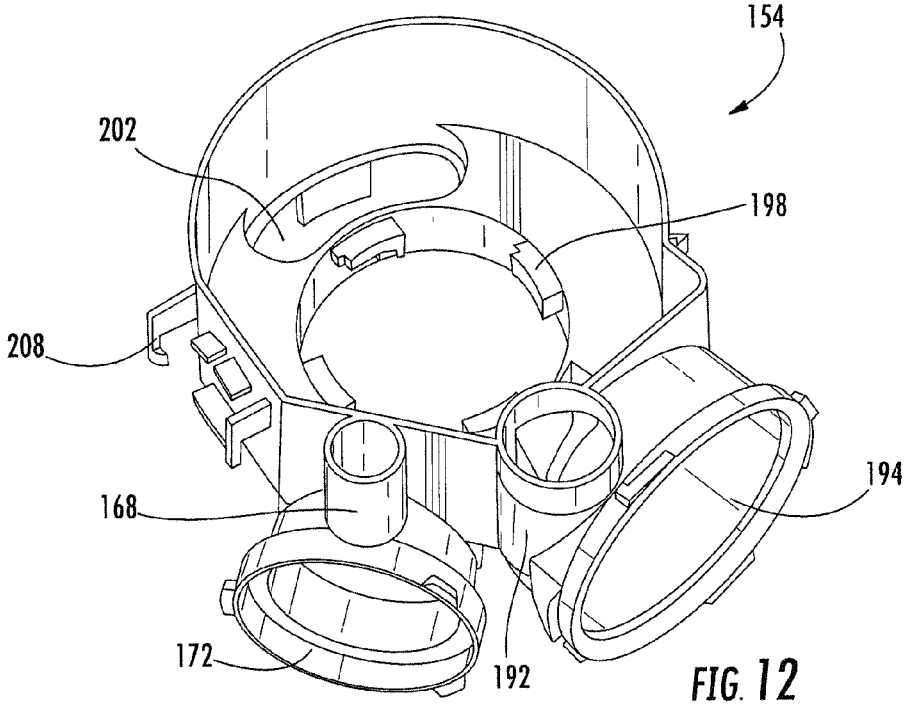
FIG. 12 is a perspective view of only the lower portion of the sump member shown in FIG. 8.
Figure 13:
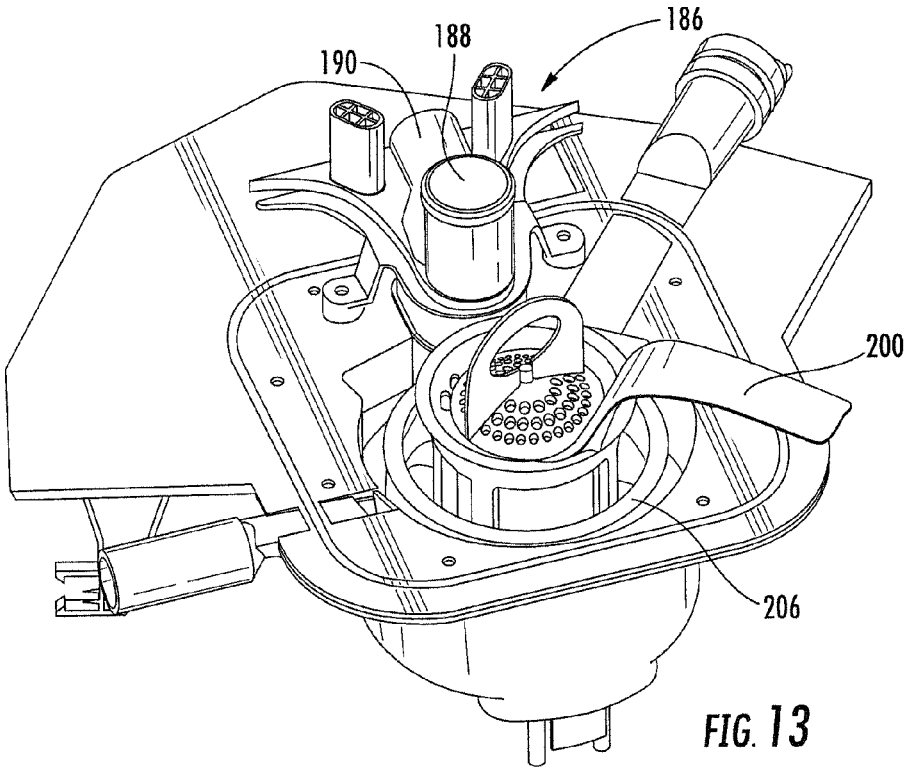
FIG. 13 is a perspective view of the sump member shown in FIGS. 8 to 12 when assembled.

When comparing the sump members of the first and second embodiments, and in particular when comparing sump member lower part 154 shown in FIG. 12, with sump member lower part 22 shown in FIG. 6, it is to be seen that the sump member lower part 154 of the second embodiment is fully contained in the sump member lower part 22 of the first embodiment and merely differs therefrom in that in the second embodiment the dishwasher does not comprise a water softening device and hence the ion exchange material tank 54, salt tank 56 as well as the various connections thereto are omitted. Thus, the sump member lower part can be designed as a modular unit, which can be used either alone as shown in FIG. 12 or in combination with an additional vessel section comprising the ion exchange material tank 54 and the salt tank 56 and which is attached about sump member lower part 154, so as to constitute a sump member lower part 22, as it is shown in FIG. 6.

With sump member lower part 154 of FIG. 12 being identical to the central portion of sump member lower part 22 shown in FIG. 6, it likewise comprises various fixations for fixing further elements of the dishwasher to the sump member, such as fixations 198 (FIG. 12) for a filter element 200 (FIG. 13), a recess 202 for accommodating a fixation 204 (FIG. 11) for a heating element 206 (FIG. 13), fixations 208 for a turbidity sensor 210 (FIG. 11), a fixation 212 which as shown in FIG. 10 is integrally provided at the sump member upper part 152 for fixation of a pressure sensor element 214 (FIG. 11), a fixation 216 for an interference filter such as a capacitor (not shown), and the like.

Figure 14:
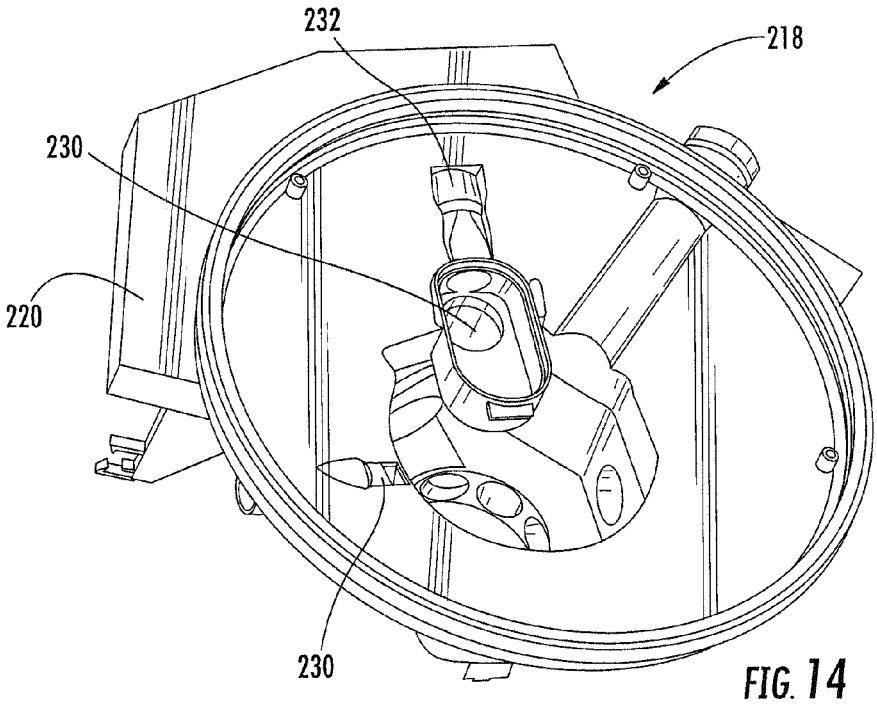
FIG. 14 is a perspective view of a sump member in accordance with yet another preferred embodiment.
Figure 15:
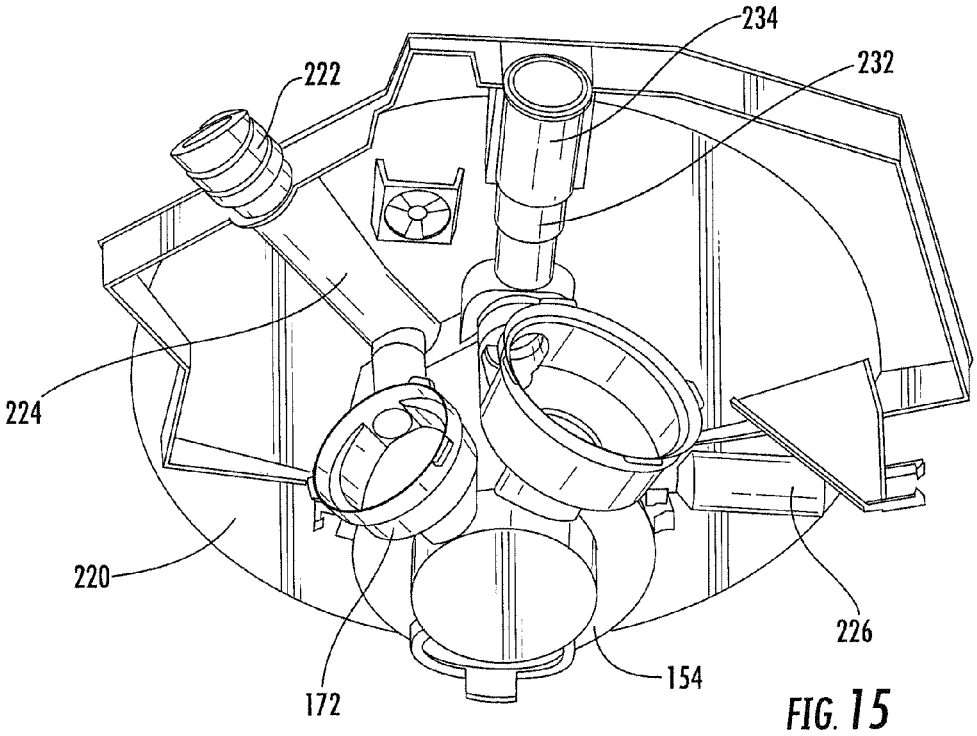
FIG. 15 is a perspective view of the sump member of FIG. 14 when viewed from below.
Figure 16:
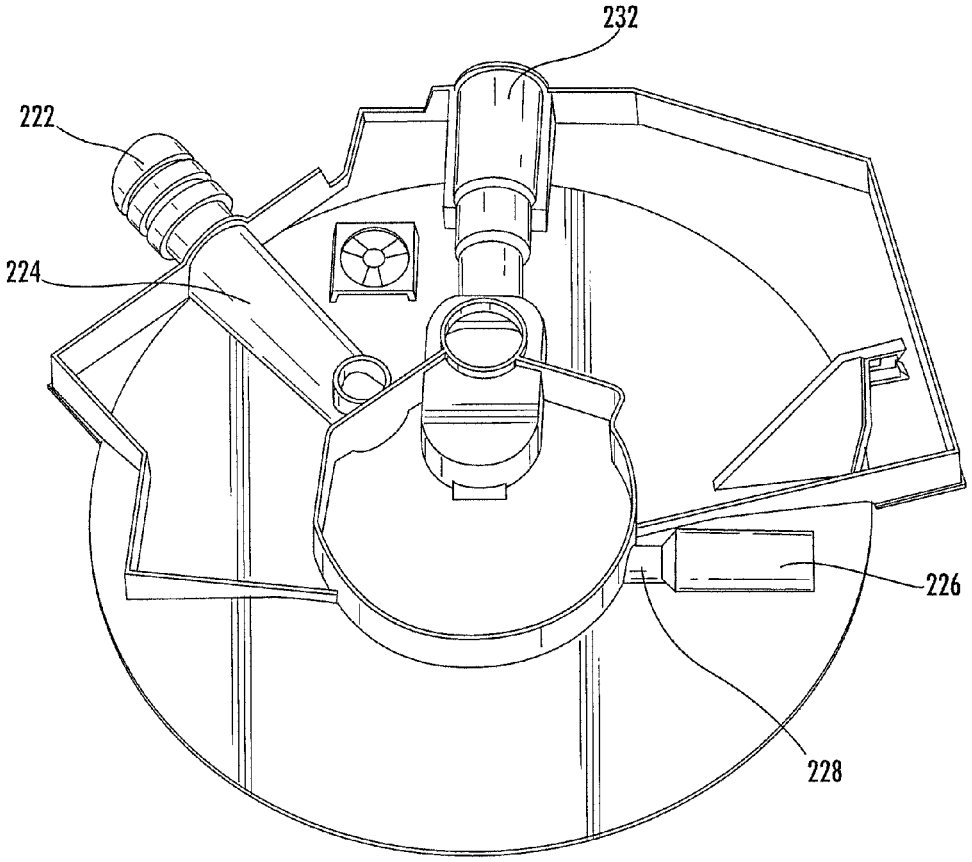
FIG. 16 is a perspective view of only the upper portion of the sump member shown in FIGS. 14 and 15.

In FIGS. 14 to 16, there is shown a third embodiment of a sump member, which is generally designated with 218. Sump member 218 comprises an upper part 220, which provides for an interface to a washing tub and which comprises integral fittings for connecting the sump member to the water circulation system of the dishwasher, as well as a sump member lower part 154 which is identical to that shown in FIG. 12.

Sump member 218 and in particular upper part 220 thereof is designed to provide for a generally funnel-shaped sump section having a surface area, which is sufficiently larger than that of the embodiments shown in FIGS. 1 to 13. Nevertheless, also sump member 218 uses the same sump member lower portion 154 as it is provided in the first and second embodiment. Thus, sump member 218 differs from sump member 150 only in the design of sump member upper part 220.

Similar as sump member upper part 152, also sump member upper part 220 comprises an integral fitting 222 for a drain tube, wherein fitting 222 connects to a passage 224 which is integrally formed in sump member upper part 220 and which communicates with housing section 172 of sump member lower part 154. Sump member upper part 220 further comprises an integral fitting 226 which connects via an integral passage 228 to an opening 230, so as to pass fresh feed water into the sump of the dishwasher. Sump member upper portion 220 further comprises an outlet opening 230 which in the assembled state of the sump member connects to vertical passage 192 which communicates with housing section 194 of sump member lower part 154.

In the embodiment shown in FIGS. 14 to 16, upper part 220 of sump member 218 further comprises an integrally formed passage 232 which leads to an integrally formed fitting 234 to which a feed conduit (not shown) can be mounted for feeding circulation water to a spray nozzle arrangement particularly to an upper spray arm. Thus, in contrast to the first and second embodiments, in which a spray arm support 18, 186 is used, which provides for distribution of the circulation water between the upper and the lower spray arm, in the third embodiment shown in FIGS. 14 to 16 a spray arm support which only feeds the lower spray arm will be fitted onto sump member 218 so as to connect to opening 230. Thus in the third embodiment shown in FIGS. 14 to 16, the means for distributing circulation water between the lower and the upper spray arm likewise is integrated into the sump member.

All further element of sump member 218 correspond to those already described in connection with the other two embodiments and hence will not be described again.

The concept suggested herein of providing a dishwasher with a sump member which is a self-contained molded plastic unit, the upper portion of which constitutes an interface for connecting the sump member in a water-tight manner to the opening provided in the washing chamber, wherein the upper portion further comprises one or more integral fittings for connecting the sump member to the water circulation system and particular to one or more water inlet conduits and/or a drain conduit, is advantageous over prior art devices in that it allows the lower portion of the sump member to be designed as a standardized component which can be combined with different types of sump member upper portions which provide for an integral interface with the remaining parts of the dishwasher and in particular with the washing tub and the water feed and water drain conduits.

| | List of parts |
|---|---|
| 10 | tub bottom |
| 12 | sump member |
| 14 | opening |
| 16 | flat filter |
| 18 | sprayarm support |
| 20 | fine filter |
| 22 | sump member lower part |
| 24 | sump member upper part |
| 26 | upper sandwich component |
| 28 | lower sandwich component |
| 30 | opening to 32 |
| 32 | water collecting receptacle |
| 34 | heating element |
| 36 | reception groove |
| 38 | salt fill opening |
| 40 | $1^{st}$ passageway |
| 42 | vertical wall at 28 |
| 44 | vertical wall at 28 |
| 46 | vertical wall at 26 |
| 48 | vertical wall at 26 |
| 50 | water inlet of 40 |
| 52 | outlet opening of 40 |
| 54 | ion exchange material tank |
| 56 | salt tank |
| 58 | vertical passage |
| 60, 62 | vertical side walls |
| 64 | outlet opening |
| 66 | vertical channel |
| 68 | outlet opening |
| 70 | outlet opening |
| 72 | $2^{nd}$ passageway |
| 74 | water inlet |
| 76 | opening of 72 |
| 78 | vertical channel |
| 80 | wall member |
| 82 | opening in 80 |
| 84 | $3^{rd}$ passageway |
| 86 | outlet opening of 54 |
| 88 | outlet opening of 84 |
| 90 | $4^{th}$ passageway |
| 92 | inlet opening of 90 |
| 94 | outlet opening of 90 |
| 96 | $5^{th}$ passageway |
| 98 | bottom of 30 |
| 100 | $1^{st}$ annular housing section |
| 102 | circulation pump |
| 104 | fixing |
| 106 | $6^{th}$ passageway |
| 107 | opening in 24 |
| 108 | outlet to upper sprayarm |
| 110 | outlet to lower sprayarm |
| 112 | $7^{th}$ passageway |
| 114 | $2^{nd}$ annular housing section |
| 116 | outlet of 114 |
| 118 | drain pump |
| 120 | opening to 122 |
| 122 | $8^{th}$ passageway |
| 124 | outlet opening 124 |
| 126 | flange element of 40 |

-continued

| | List of parts |
|---|---|
| 128 | flange element of 72 |
| 130 | flange element of 122 |
| 132 | opening for 134 |
| 134 | turbidity sensor |
| 136 | fixation for 134 |
| 138 | reed float housing |
| 140 | reed switch |
| 142 | opening in 138 |
| 144 | fixation |
| 146 | $9^{th}$ passageway |
| 148 | branch-off from 40 |
| 150 | sump member |
| 152 | sump member upper part |
| 154 | sump member lower part |
| 156 | reception groove |
| 158 | upper sandwich component |
| 160 | lower sandwich component |
| 162 | fitting for drain tube |
| 164 | passage |
| 166 | opening of 164 |
| 168 | vertical passage |
| 170 | opening of 168 |
| 172 | housing section |
| 174 | drain pump |
| 176 | fitting for water feed |
| 178 | passage |
| 180 | outlet opening |
| 182 | water collecting receptacle |
| 184 | outlet opening |
| 186 | sprayarm support |
| 188 | upper sprayarm feed conduit |
| 190 | lower sprayarm feed conduit |
| 192 | vertical passage |
| 194 | housing section |
| 196 | circulation pump |
| 198 | fixation for 200 |
| 200 | filter |
| 202 | recess |
| 204 | fixation for 202 |
| 206 | heating element |
| 208 | fixation for 210 |
| 210 | turbidity sensor |
| 212 | fixation for 214 |
| 214 | pressure sensor |
| 216 | fixation for interference filter |
| 218 | sump member |
| 220 | sump member upper part |
| 222 | fitting for drain tube |
| 224 | passage |
| 226 | fitting for water feed |
| 228 | passage |
| 230 | outlet opening |
| 232 | passage |
| 234 | fitting |

The invention claimed is:

1. A dishwasher comprising a wash chamber, a water circulation system for passing water into and out of the wash chamber, and a water-collecting sump member which is fastened in a water-tight manner to an opening in a lower end portion of the wash chamber, wherein the sump member is a self-contained molded plastic unit comprising an upper part which constitutes an interface for connecting the sump member in a water-tight manner to said opening, and a lower part attached to the upper part, the lower part comprising a water collecting receptacle, wherein said upper part comprises at least one integral fitting configured to directly engage at least one of a mains fresh water inlet tube or a drain waste outlet tube of the dishwasher, and wherein the upper part is directly attached to the opening in the lower end portion of the wash chamber and the lower part is directly attached to a bottom part of the upper part so that the lower part is only attached to the lower end portion of the wash chamber via the upper part.

2. The dishwasher of claim 1, wherein the lower part comprises an integral first housing section for accommodating an impeller of a circulation pump and/or an integral second housing section for accommodating an impeller of a drain pump.

3. The dishwasher of claim 1, wherein the upper part of said sump member comprises at least one integral fitting for a spray arm feed conduit.

4. The dishwasher of claim 1, wherein the at least one integral fitting is adapted for snap-fit connection to a respective tube to be connected to said fitting.

5. The dishwasher of claim 1, wherein the upper and lower parts of the sump member are connected to each other in a liquid-tight manner.

6. The dishwasher of claim 1, wherein the upper and lower parts of the sump member comprise integral parts of the sump member.

7. The dishwasher of claim 1, wherein the upper part of the sump member comprises a seal which is adapted for water-tight sealing of corresponding contact areas of said upper part of the sump member and the lower end portion of the wash chamber.

8. The dishwasher of claim 1, wherein the sump member comprises at least one integrated passage that is formed at least in part integrally with the sump member for passing water to at least one hydraulic component of the dishwasher.

9. The dishwasher of claim 8, wherein the at least one hydraulic component of the dishwasher and the at least one integrated passage of the sump member for passing water to said hydraulic component are selected from the group consisting of:

an ion exchange material tank of a water softening device for accommodating an ion exchange material and an integrated first passage for passing water from a water inlet to said ion exchange material tank;

a salt tank of a water softening device for accommodating a salt solution for the regeneration of a water softening ion exchange material and an integrated second passage for passing water from a water inlet to said salt tank;

an ion exchange material tank of a water softening device for accommodating an ion exchange material and an integrated third passage for passing water from said ion exchange material tank to said wash chamber;

an ion exchange material tank of a water softening device for accommodating an ion exchange material and an integrated third passage for passing water from said ion exchange material tank to a water collecting space of the sump;

an ion exchange material tank of a water softening device for accommodating an ion exchange material and a salt tank of a water softening device of the dishwasher for accommodating a salt solution for the regeneration of said ion exchange material, and an integrated fourth passage for passing salt solution from said salt tank to said ion exchange material tank;

a circulation pump and an integrated fifth passage for passing circulation water from the sump to said circulation pump;

a circulation pump and a water distribution system and an integrated sixth passage for passing pressurized circulation water from said circulation pump to said water distribution system;

a drain pump and an integrated seventh passage for passing waste water from the sump to said drain pump;

a drain pump and a drain tube and an integrated eighth passage for passing pressurized waste water from said drain pump to said drain tube; and an ion exchange material tank of a water softening device for accommodating an ion exchange material and a circulation pump, and an integrated first passage for passing water from a water inlet to said ion exchange material tank and an integrated ninth passage which branches off from the first passage upstream of the ion exchange material tank for passing at least a portion of the water passing through the first passage into one of said wash chamber and a water collecting space of the sump member.

10. The dishwasher of claim 9, wherein at least part of the upper part, including part of the at least one integrated passage and part of the at least one integral fitting, defines a single molded piece of the plastics material.

11. The dishwasher of claim 1, wherein the upper part of the sump member comprises a generally flat sandwich-type structure comprising an upper sandwich component and a lower sandwich component which enclose an intermediate space therebetween forming at least part of said at least one integrated passage.

12. The dishwasher of claim 11, wherein the intermediate space between the upper and the lower sandwich components comprises at least two essentially vertical wall sections, which together with the surface areas of the upper and the lower sandwich components that are located between the said vertical wall sections constitute at least a portion of said at least one integrated passage.

13. The dishwasher of claim 12, wherein a vertical wall section provided at one of said upper and lower sandwich components is connected to the respective other of said upper and lower sandwich components by gluing or welding.

14. The dishwasher of claim 1, wherein the sump member comprises at least one integrated fixation for mounting electric components of the dishwasher at the sump member.

15. The dishwasher of claim 1, wherein the lower part of the sump member further comprises at least one of an ion exchange material tank and a salt tank, and wherein the upper part of the sump member extends at least over a portion of said water-collecting receptacle, said ion exchange material tank and/or said salt tank.

16. The dishwasher of claim 1, wherein a filter sieve is provided in the opening in the lower end portion of the wash chamber.

17. The dishwasher of claim 1, wherein the sump member is made of moldable plastic material which is resistant to alkaline and hot water, preferably polypropylene.

18. The dishwasher of claim 1, wherein the upper part of the sump member comprises the at least one integral fitting for connecting the sump member to a water inlet conduit and a second integral fitting for connecting the sump member to the drain conduit of the dishwasher.

* * * * *